US006347434B1

(12) United States Patent
Newman

(10) Patent No.: US 6,347,434 B1
(45) Date of Patent: Feb. 19, 2002

(54) SECURITY CABLE TIE

(76) Inventor: Arnold S. Newman, 4254 Greenleaf Ct. - Apt. #206, Park City, IL (US) 60085

( * ) Notice: Subject to any disclaimer, the term of this patent is extended or adjusted under 35 U.S.C. 154(b) by 0 days.

(21) Appl. No.: 09/474,547

(22) Filed: Dec. 29, 1999

(51) Int. Cl.[7] ..... B65D 63/10
(52) U.S. Cl. ..... 24/16 PB; 24/30.5 P
(58) Field of Search ..... 24/16 R, 16 PB, 24/17 A, 17 AP, 30.5 P; 248/74.3

(56) References Cited

U.S. PATENT DOCUMENTS

| | | | | | |
|---|---|---|---|---|---|
| 3,102,311 | A | * | 9/1963 | Martin et al. | 24/16 PB |
| 3,488,813 | A | * | 1/1970 | Kohke | 24/16 PB |
| 3,949,449 | A | | 4/1976 | Caveney et al. | |
| 4,272,870 | A | * | 6/1981 | McCormick | 24/16 PB |
| 4,287,644 | A | * | 9/1981 | Durand | 24/16 PB |
| 4,473,524 | A | * | 9/1984 | Paradis | 24/16 PB |
| 4,502,187 | A | * | 3/1985 | Kitagawa | 24/16 PB |
| 4,537,432 | A | * | 8/1985 | Meeks | 24/16 PB |
| 4,688,302 | A | | 8/1987 | Caveney et al. | |
| 4,866,816 | A | | 9/1989 | Caveney | |
| 5,031,943 | A | * | 7/1991 | Scott et al. | 24/16 PB |
| 5,193,250 | A | | 3/1993 | Caveney | |
| 5,440,786 | A | | 8/1995 | Sorensen et al. | |
| 5,593,630 | A | | 1/1997 | Sorensen et al. | |
| 5,664,294 | A | * | 9/1997 | Sorensen et al. | 24/16 PB |
| 5,792,409 | A | | 8/1998 | Sorensen et al. | |
| 5,836,053 | A | | 11/1998 | Davignon et al. | |
| 5,884,367 | A | | 3/1999 | Teagno et al. | |
| 5,911,367 | A | | 6/1999 | McInerney | |
| 5,924,171 | A | | 7/1999 | Sorensen et al. | |

* cited by examiner

*Primary Examiner*—James R. Brittain
(74) *Attorney, Agent, or Firm*—Thomas R. Vigil

(57) ABSTRACT

The cable tie comprises an elongate strip with a locking head formed at one end of the strip and having a passage or opening therethrough. The strip has spaced apart teeth formed in or on one side thereof. The passage or opening in the locking head has at least one tooth on one side thereof and at least one pressure rib on the other side thereof. Further, the passage or opening in the head is constructed, sized and arranged with a distance between the one side and the other side relative to the thickness of the strip which will permit the strip to be pushed or pulled through the passage or opening with the teeth on the strip ratcheting over the at least one tooth on the one side of the passage or opening and past the at least one pressure rib on the other side of the passage or opening, and so that, when the strip is pulled or pushed in a reverse direction, the at last one pressure rib will urge the strip and the teeth on the other side of the strip into locking engagement with the teeth on the one side of the passage or opening.

15 Claims, 5 Drawing Sheets

SECURITY CABLE TIE

BACKGROUND OF THE INVENTION

1. Field of the Invention

The present invention relates to a security cable tie comprising a strip of plastic having integrally molded at one end thereof a head. The head has a passage or opening therethrough with teeth on one side of the passage and at least one pressure rib on the other side of the passage. One side of the strip has teeth thereon which are adapted to ratchet past teeth in the passage while being biased toward the teeth by the at least one rib on the other side of the passage. Then, when a sufficient length of the strip has been pulled through the passage, the reverse movement of the strip will cause the teeth on the strip to engage and lock with the teeth on one side of the passage while the at least one rib on the other side of the passage urges the strip toward the teeth on the other side of the passage.

2. Description of the Prior Art

Heretofore a number of integral one piece cable ties have been proposed, each of them including a strip of plastic material having a head at one end thereof with a passage through the head and some form of ratcheting or pawl type structure within the passage for engaging teeth on one side of the strip of plastic material.

Examples of previously proposed cable ties are disclosed in the following U.S. patents:

| U.S. Pat. No. | Patentee |
|---|---|
| 3,949,449 | Caveney et al. |
| 4,688,302 | Caveney et al. |
| 4,866,816 | Caveney |
| 5,193,250 | Caveney |
| 5,440,786 | Sorensen et al. |
| 5,593,630 | Sorensen et al. |
| 5,792,409 | Sorensen et al. |
| 5,836,053 | Davignon et al. |
| 5,884,367 | Teagno et al. |
| 5,911,367 | McInerney |
| 5,924,171 | Sorensen et al. |

All but two of the prior art U.S. patents listed above disclose some form of pawl for engaging teeth or ribs on one side of a strip of plastic.

The Davignon et al. U.S. Pat. No. 5,836,053 discloses a passage through a head at one end of a cable tie having a ramp surface on one side thereof for engaging a side of a tooth after the tooth is pulled through the passage and a cut-away groove for engaging a lower corner of an adjacent tooth, thereby to hold a plastic strip pulled through the passageway at an angle of approximately 30° to 60° relative to the passage.

The McInerney U.S. Pat. No. 5,911,367 discloses a passageway which extends almost parallel to the strip through a head at one end of a strip of plastic material. The head also has first and second spaced apart openings communicating with the passage whereby the other end of the strip can be pulled through the first opening through the generally axially extending passage and through the second opening and past teeth on a section of plastic in the head between the openings. A reverse pull on the strip of plastic will cause teeth on the strip to engage with teeth on the section of plastic between the openings in the head of the strip.

SUMMARY OF THE INVENTION

According to the present invention there is provided a cable tie comprising: an elongate strip and a locking head formed at one end of the strip and having a passage or opening therethrough. The strip has spaced apart teeth formed in or on one side thereof. The passage or opening in the locking head has at least one tooth on one side thereof and at least one pressure rib on the other side thereof. Further, the passage or opening in the head is constructed, sized and arranged with a distance between the one side and the other side relative to the thickness of the strip which will permit the strip to be pushed or pulled through the passage or opening with the teeth on the strip ratcheting over the at least one tooth on the one side of the passage or opening and past the at least one pressure rib on the other side of the passage or opening, and so that, when the strip is pulled or pushed in a reverse direction, the at least one rib will urge the strip and the teeth on the other side of the strip into locking engagement with the teeth on the one side of the passage or

DESCRIPTION OF THE PREFERRED EMBODIMENT(S)

Figure 1:
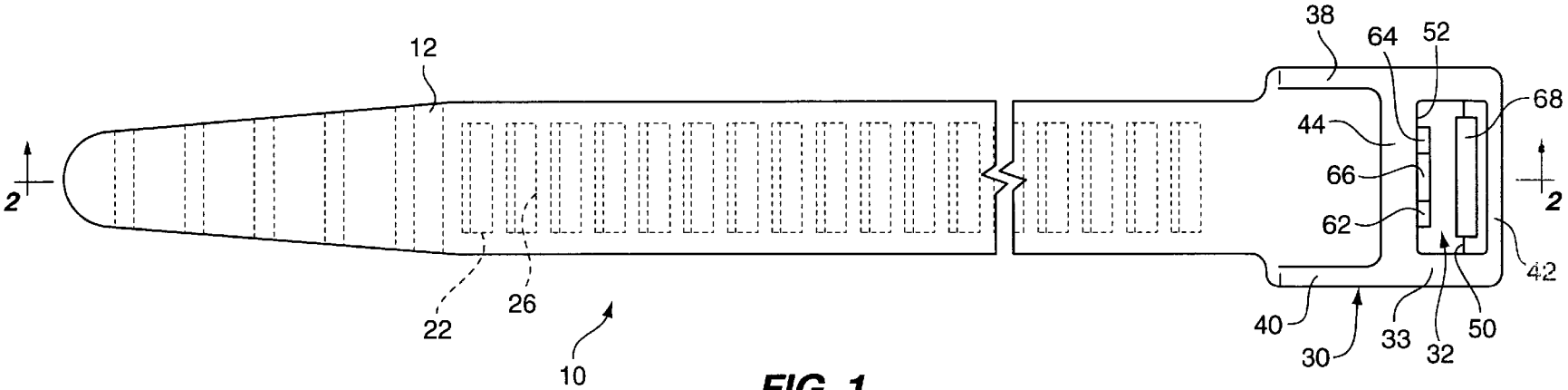
FIG. 1 is a top plan view of the security cable tie of the present invention.

Referring now to FIG. 1 in greater detail, there is illustrated therein a security cable tie, or simple cable tie 10, which comprises an elongate strip 12 of plastic material which can have any desired length, one such length being between approximately 15 and 17 inches.

Figure 2:
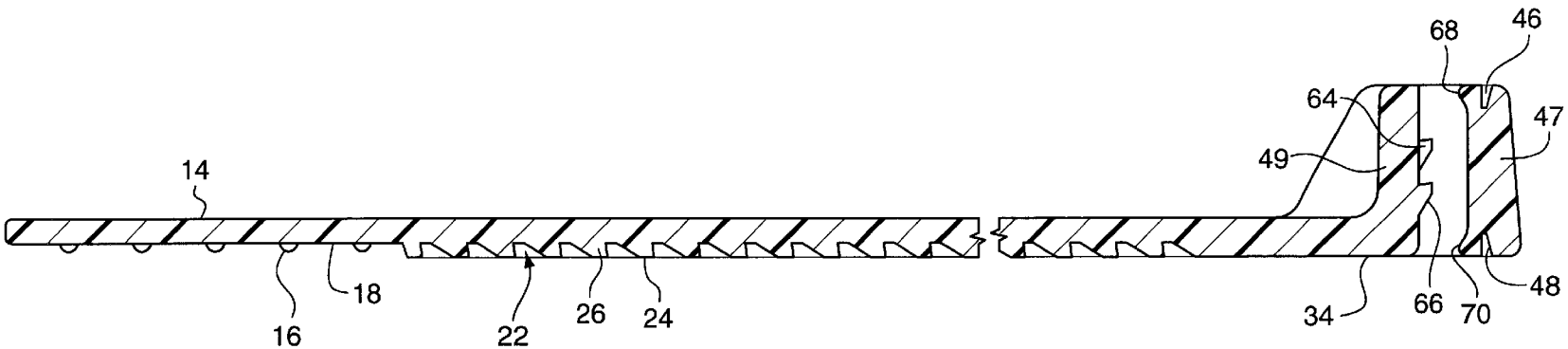
FIG. 2 is an elongate sectional view through the cable tie shown in FIG. 1 and is taken along lines 2—2 of FIG. 1.
Figure 3:
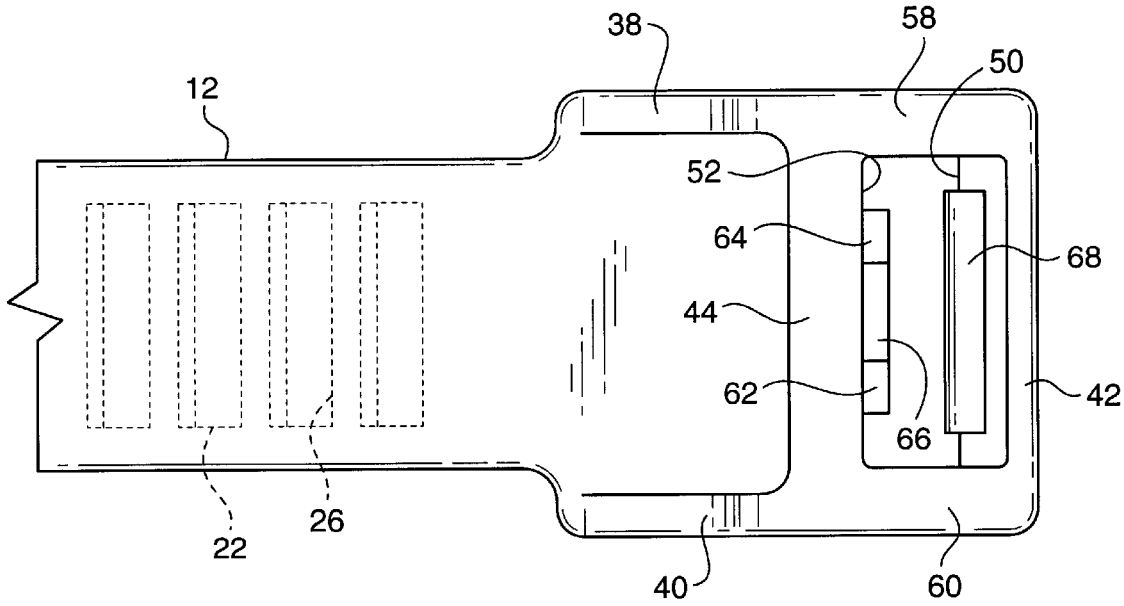
FIG. 3 is an enlarged top plan view of the head of the cable tie shown in FIG. 1.
Figure 8:
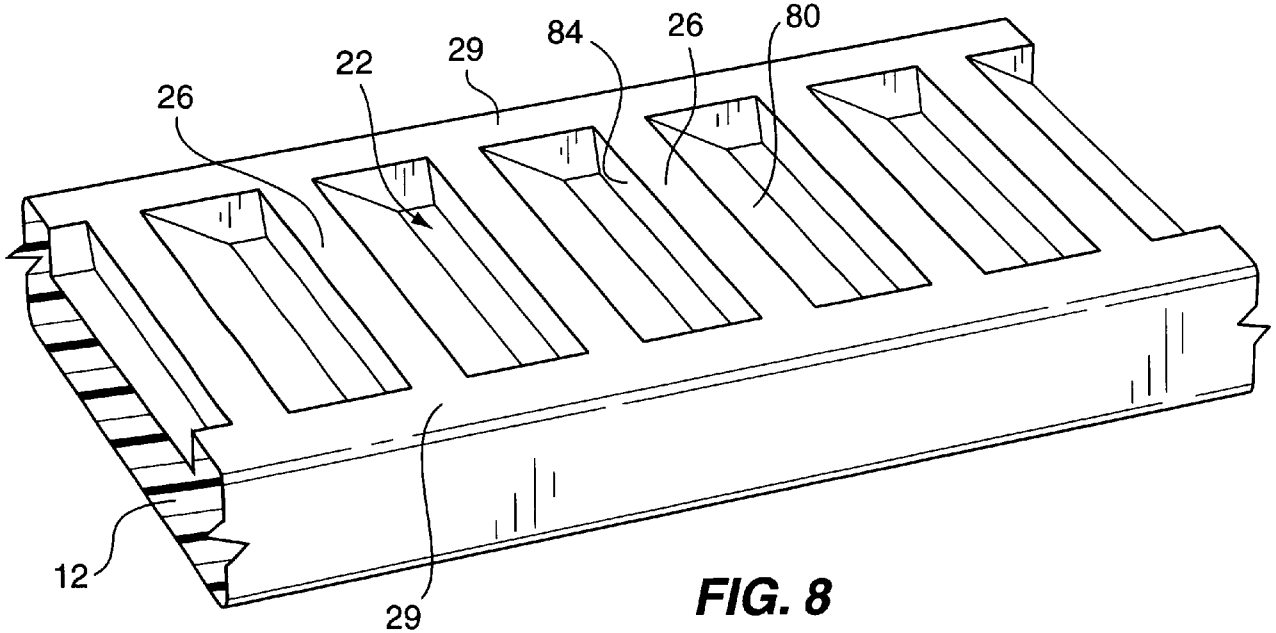
FIG. 8 is a fragmentary perspective view of the underside of the strip shown in FIGS. 1 and 2 and shows spaced apart cavities formed in the strip thereby to form teeth therebetween.

The elongate strip 12 of plastic material has an end tab 14 with finger gripping ribs 16 on one side 18 thereof and an elongate body 20, as shown in FIGS. 1 and 2. The body 20 of the strip 12 has spaced apart cavities 22 formed in one side 24 thereof, which, in the illustrated embodiment, are generally rectangular and have a trapezoidal shape thereby to define between each cavity 22 a trapezoidal tooth 26 having a blunt outer end 28 which is co-extensive with the one side 24 of the body 20 of the strip 12 and opposed side rails 29 (FIG. 8).

At the other end of the strip 12 there is a head 30 which has a greater width than the width of the strip 12 and a height or thickness above the strip 12. As shown, the head 30 has a generally rectangular passage or opening 32 therethrough.

The head 30 has an upper side 33 spaced from the plane of the strip 12 and a lower side 34 co-extensive with the one side 24 of the body 20 of the strip 12. The head 30 has, on each side of the strip 12, a reinforcing wall 38, 40 which is shown in FIGS. 2 and 4 and extends at an angle downwardly from the upper side 33 to, and merges with, the strip 12.

As shown in FIGS. 1 and 2, the head 30 can be defined as having an outer wall 42 on other side of the passage or opening 32 and an inner wall 44 on the one side of the passage or opening 32.

Figure 4:
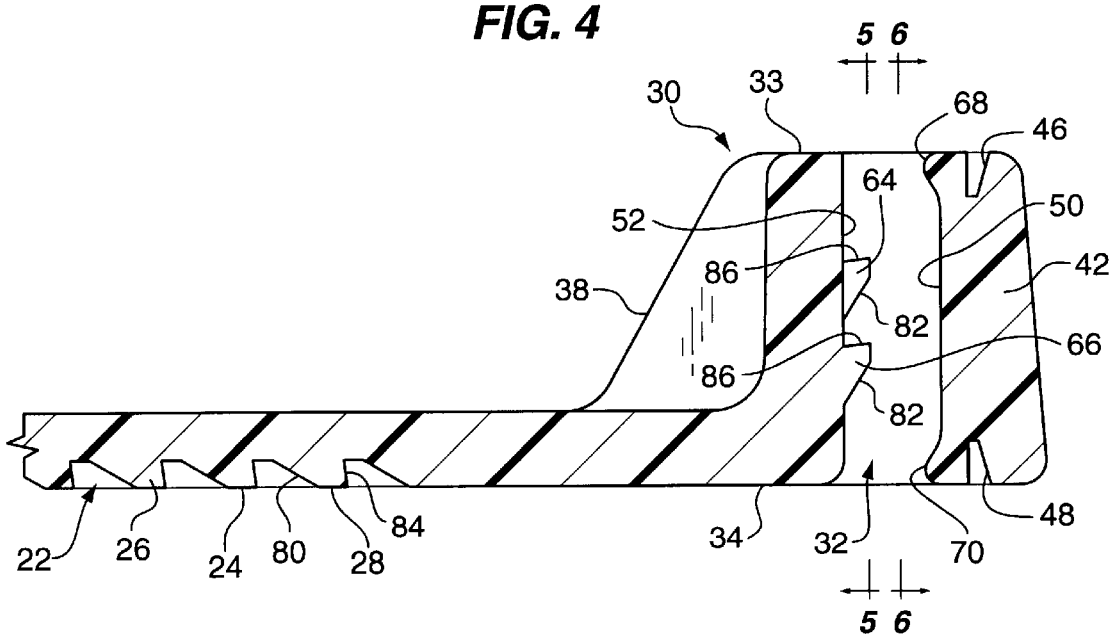
FIG. 4 is an enlarge sectional view through the head of the cable tie similar to the view shown in FIG. 2.

As best shown in FIGS. 2 and 4, the outer wall 42 has a groove 46 formed, at least partially across the upper side 33 of the head 30 and a similar groove 48 in the lower side 34 in the 42.

The passage or opening 32 is defined by a side 50 of the outer wall 42, a side 52 of the inner wall 44 and inner sides 54, 56 of passage end walls 58 and 60.

Figure 5:
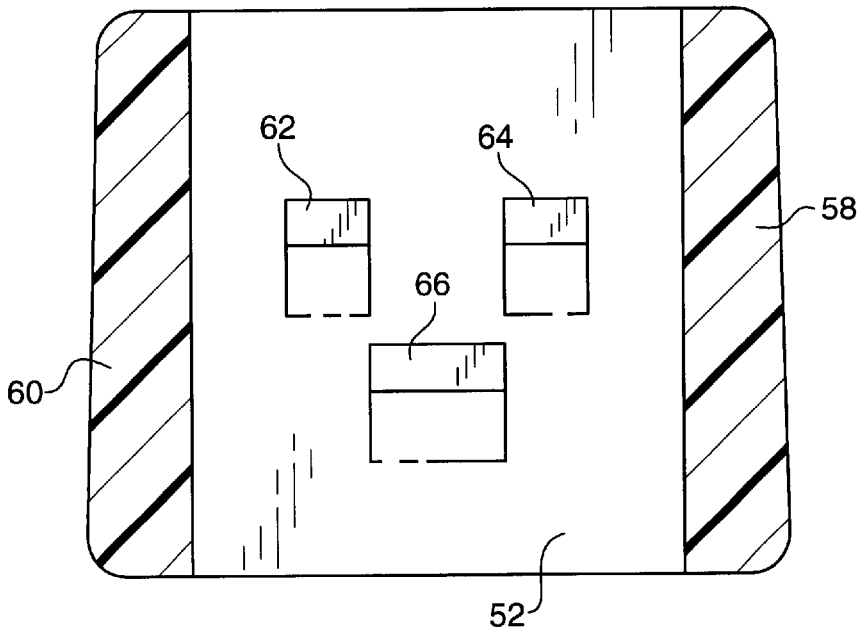
FIG. 5 is a vertical sectional view of through the head, shows one side of the passage or opening through the head of the cable tie and is taken along line 5—5 of FIG. 4.

As best shown in FIGS. 2 and 5, the side 52 of the inner wall 44 defines one side 52 of the passage or opening 32 through the head 30 and has a first pair of upper teeth 62, 64 thereon, each having a trapezoidal shape similar to the trapezoidal shape of the cavities 22 in the underside 24 of the strip 12 of plastic material.

Then, positioned below that pair of teeth 62, 64 is a center tooth 66 also having the same generally trapezoidal shape of one of the cavities 22, as shown in FIG. 5.

Figure 6:
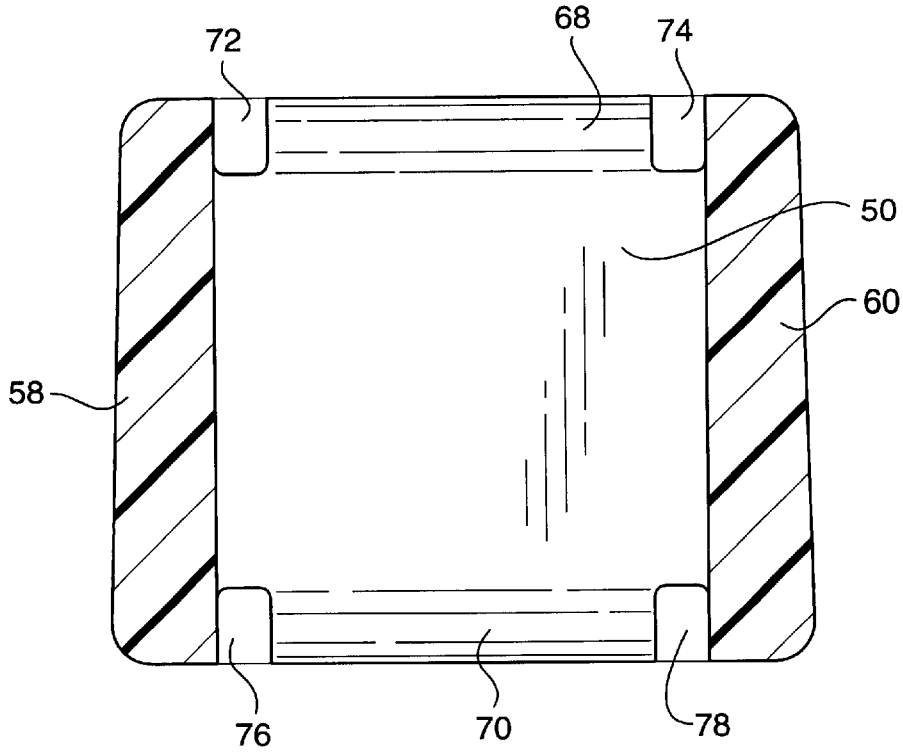
FIG. 6 is a vertical sectional view through the head of the cable tie, shows the other side of the passage or opening through the head and is taken along line 6—6 of FIG. 4.

Referring now to FIGS. 2 and 6, it will be seen that the side 50 of the outer wall 44 defines the other side 50 of the passage or opening 32 through the head 30. The side 50 has an upper pressure rib 68 and a lower pressure rib 70 formed therein.

According to the teachings of the present invention, these ribs 68 and 70 extend from the other side 50 a distance between 0.008 inch and 0.020 inch. One preferred dimension for the lateral extent of the ribs 68, 70 is approximately 0.012 of an inch.

It will be noted that the upper rib 68 is defined between two upper slots 72 and 74 in the outer wall 44 which separate the upper rib from the opposed passage end walls 58 and 60 defining the passage or opening 32. These slots 72, 74 and the groove 46, facilitate the molding of the cable tie 10.

Similar slots 76 and 78 are provided on the lower side 34 of the wall 44 at opposite sides of the rib 70 and communicate with the groove 48, also for the purpose of facilitating molding of the cable tie 10.

Figure 7:
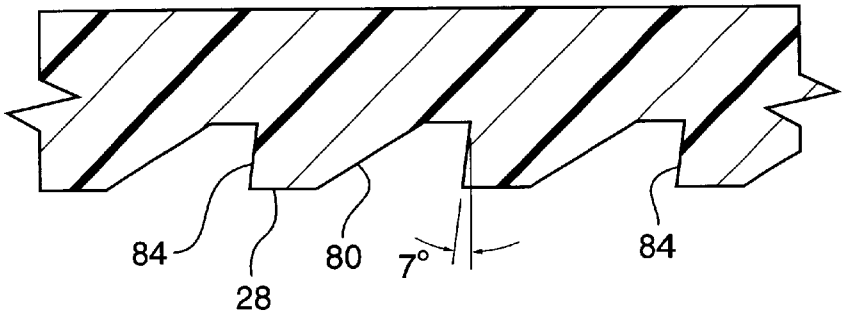
FIG. 7 is an enlarged fragmentary sectional view of modified teeth in the strip of the cable tie, similar to the teeth shown in FIGS. 2 and 4 but with a 7° incline angle on the front side of each tooth.

Referring now to FIG. 7, it will be seen that the teeth 26 formed in the side 24 of the strip 12 each have an inclined ramp surface 80 to assist in the ratchet movement between the teeth 26 and the three teeth 62, 64 and 66 on the side 52. Each of the teeth 62, 64 and 66 has a similar inclined ramp surface 82. Then, as shown, each tooth 26 has a front face 84 positioned generally normal to an elongate axis of the strip 12 for abbutting against and locking against a similar front face 86 of each of the teeth 62,64 and 66. Further, as shown in FIG. 7, the front face 84 and/or 86 can have a forward incline of, for example 7°, to provide a better "bite" or gripping of the teeth 26 with the teeth 62, 64 and 66.

It is to be understood, of course, that a slant or incline smaller or greater than at an angle of 7° can be provided to the front face 84 and/or 86 of the teeth 26 and/or 62, 64 and 66.

Figure 9:
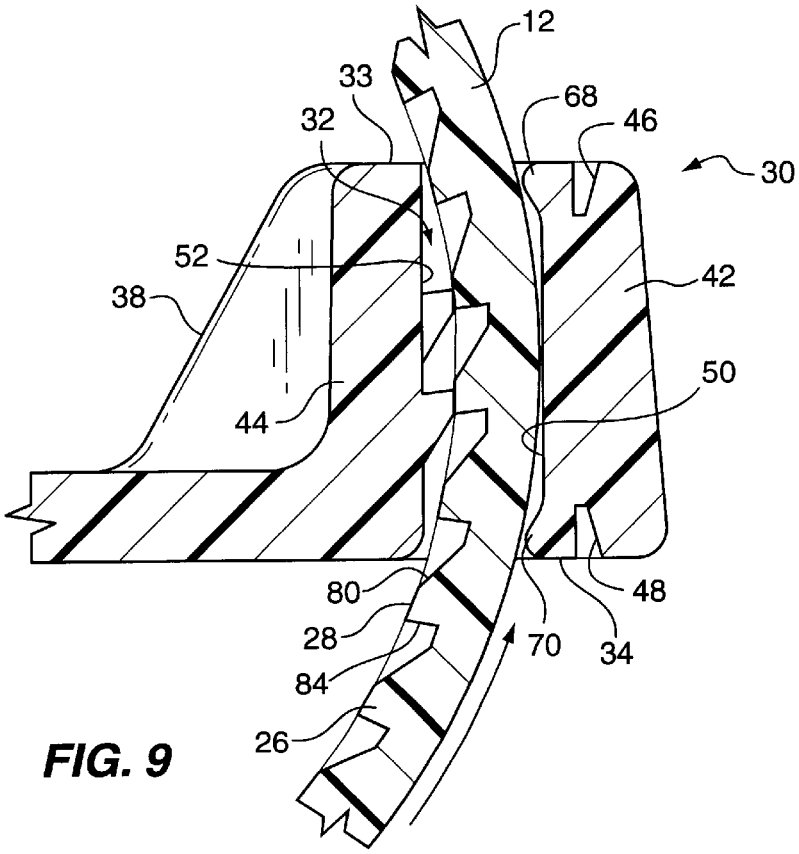
FIG. 9 is a vertical sectional view of the head similar to the sectional view shown in the right hand side of FIG. 2 and in FIG. 4 of the head but also showing a portion of the strip being pushed or pulled through the passage or opening in the head.
Figure 10:
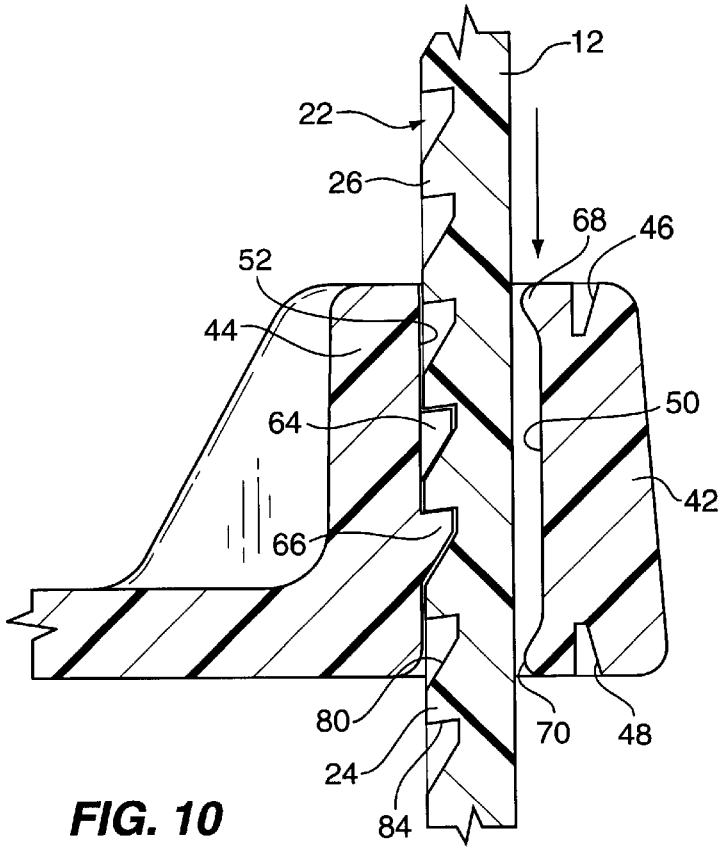
FIG. 10 is a vertical sectional view similar to the view shown in FIG. 9 but shows the teeth on the underside of the strip engaging and locking with teeth on the one side of the passage or opening.

As best shown in FIGS. 9 and 10, the strip 12 of material is fed through the passage or opening 32 by inserting it from the lower side 34 of the head 30 through passage or opening 32 to the upper side 33 of the head 30. This is shown in FIG. 9. During this insertion, there can and will be some flexing of the strip 12 to a curved position so that it can be fed through the passage or opening 32, as shown in FIG. 9 with the teeth 26 ratcheting past the teeth 62, 64 and 66.

Then, after a sufficient length of the strip 12 has been pushed or pulled through the passage or opening 32, a reverse pull or push is imparted to the strip 12 to cause the teeth 26 to engage and lock with the teeth 62, 64 and 66 on the one side 52 of the passage or opening 32 as best shown in FIG. 10. In this way, a simple and effective locking of the plastic strip 12 in the passage or opening 32 is obtained.

It is to be noted that the locking arrangement shown in FIG. 10 is very difficult to pry open, since there is no pawl that can be engaged with a safety pin or nail for moving the pawl, thereby to enable one to pull the strip of material in the locking direction out of the passage or opening 32. In this respect, to deflect the rib 68, one, would have to put pressure on the upper surface of the strip thereby forcing the teeth into more locking engagement with the teeth on the side 52 of the passage or opening 32 which would serve to furter lock the teeth 26 with the teeth 62, 64 and 66.

Additionally, one would have to deflect not only the upper rib 68 but also the lower rib 70 and this is practically impossible to do. Accordingly, the only way the locking engagement between the teeth 26 on the underside 24 of the strip 12 and the teeth 62, 64 and 66 on the side 52 defining one side 52 of the passage or opening 32 can be severed by cutting through the strip 12 or the head 30 and typically it is easier to cut through the strip 12 than the head 30, since less material has to be cut.

From the foregoing description, it will be understood that the security cable tie 10 of the present invention has a number of advantages, some of which have been described above and others of which are inherent in the security cable tie 10 of the present invention. It will also be understood that modifications can be made to the security cable tie 10 without departing from the teachings of the present invention.

Accordingly, the scope of the invention is only to be limited as necessitated by the accompanying claims.

I claim:

1. A cable tie comprising an elongate strip with a locking head formed at one end of said strip and having a passage or opening therethrough; said strip having spaced apart teeth formed in or on one side thereof and having an unobstructed surface on the other side thereof; said passage or opening in said locking head having at least two fixed teeth on one side of said passage or opening; and said passage or opening in said locking head having at least one pressure rib on the other side thereof; said passage or opening in said head being constructed, sized and arranged with a distance between said one side and said other side relative to the thickness of said strip which will permit said strip to be pushed or pulled through said passage or opening with said teeth on said strip ratcheting over said teeth on said one side of said passage or opening and past said at least one pressure rib on said other side of said passage or opening, and so that, when said strip is pulled or pushed in a reverse direction, said at last one pressure rib will urge said strip and said teeth on said other side of said strip into locking engagement with said teeth on said one side of said passage or opening.

2. The cable tie of claim 1 wherein said passage or opening has an entry and an exit and at least two pressure ribs are provided on said other side of said passage or opening with one rib being at the entry and the other rib being at the exit of said passage or opening.

3. The cable tie of claim 1 wherein said at least one pressure rib extends between approximately 0.008 and 0.020 inch from said other side of said passage or opening.

4. The cable tie of claim 3 wherein said at least pressure rib extends approximately 0.012 inch from said other side of said opening.

5. The cable tie of claim 1 wherein said head has a wall on said other side of said passage or opening and said wall has end surfaces, said at least one pressure rib extends from said wall of said locking head adjacent one of said end surfaces and said end surface has a groove therein behind said at least one pressure rib.

6. The cable tie of claim 5 wherein said at least one pressure rib extends along said other side of said passage or opening on said wall toward but not to one of two opposite passage end walls defining, with said one side and said other side, said passage or opening and said wall having said opposite side also having a slot in an end surface at each end of said at least one pressure rib, each slot communicating with said groove.

7. The cable tie of claim 1 wherein said fixed teeth comprise a pair of teeth and a third tooth on said one side of said passage or opening and said pair of teeth are spaced laterally apart and are spaced above or below said third tooth on said one side of said passage or opening.

8. The cable tie of claim 7 wherein said third tooth spaced above or below said pair of teeth is located centrally between said pair of teeth.

9. The cable tie of claim 1 wherein said teeth on said one side of said passage and said teeth on one side of said strip each have a forwardly inclined front face which provides a stronger gripping force.

10. The cable tie of claim 9 wherein said front face of each tooth is inclined forwardly approximately 7°.

11. The cable tie of claim 1 wherein said one side of said strip has a plurality of equally spaced cavities therein defining therebetween said teeth in said one side of said strip between side rails.

12. The cable tie of claim 11 wherein said cavities each have a generally trapezoidal shape thereby to form trapezoidal shaped ratchet teeth with a ramp surface on one side of each tooth and a flat front surface on the other side of each tooth, generally normal to an elongate axis of said strip.

13. The cable tie of claim 12 wherein said teeth on said one side of said passage or opening have a trapezoidal ratchet shape with a ramp surface on one side of each tooth and a flat front surface on the other side of each tooth, generally normal to an elongate axis of said passage or opening.

14. The cable tie of claim 1 wherein said passage or opening in said head extend transversely of an elongate axis of said strip.

15. The cable tie of claim 14 wherein said passage or opening extends generally normal to said elongate axis of said strip.

* * * * *